United States Patent [19]

Fischer

[11] Patent Number: 4,732,006

[45] Date of Patent: Mar. 22, 1988

[54] ICEMAKERS AND METHODS OF MAKING ICE

[75] Inventor: Harry C. Fischer, Maggie Valley

[73] Assignee: Remcor Products Company, Franklin Park, Ill.

[21] Appl. No.: 12,787

[22] Filed: Feb. 9, 1987

[51] Int. Cl.[4] ..... F25C 5/02

[52] U.S. Cl. ..... 62/71; 62/353

[58] Field of Search ..... 62/71, 353, 354, 73, 62/352; 165/94, 95

[56] References Cited

U.S. PATENT DOCUMENTS

| | | | |
|---|---|---|---|
| 2,280,320 | 4/1942 | Taylor | 62/354 X |
| 2,997,861 | 8/1961 | Kocher et al. | 62/347 |
| 4,295,519 | 10/1981 | Bellaff | 165/94 X |
| 4,363,223 | 12/1982 | Abbott | 62/347 X |
| 4,429,543 | 2/1984 | Fischer | 62/347 X |
| 4,510,768 | 4/1985 | Keller | 62/354 X |

*Primary Examiner*—William E. Tapoicai

*Attorney, Agent, or Firm*—Juettner Pyle Lloyd & Verbeck

[57] ABSTRACT

Icemakers are characterized by a plurality of vertical evaporator tubes arranged in parallel and in a circle within the interior of a cylindrical ice making section. During an ice making cycle, water is supplied to the exterior surfaces of the evaporator tubes and refrigerant is supplied to the interiors of the tubes, to cause tubes of ice to freeze on the evaporator tubes. At the end of the ice making cycle and during a harvest cycle, the evaporator tubes are heated to free the ice tubes from their bond to the evaporator tubes, and a driver is actuated to move the ice tubes slidably along and off of the evaporator tubes and to fracture the leading ends of the ice tubes into smaller pieces of ice as they leave the evaporator tubes. In one embodiment, the driver comprises a piston for pushing the ice tubes off of the evaporator tubes. In another embodiment, a helical driver moves the ice tubes off of the evaporator tubes.

24 Claims, 4 Drawing Figures

ICEMAKERS AND METHODS OF MAKING ICE

BACKGROUND OF THE INVENTION

The present invention relates generally to ice making apparatus and methods of making ice, and in particular to such apparatus and methods in which ice is formed on a plurality of vertically oriented and parallel evaporator tubes.

There have been various attempts to make pieces of ice by forming an elongated section of ice and then somehow fracturing the ice section to form pieces which may or may not resemble ice "cubes", which are generally thought of as being formed individually, oftentimes in individual cavities. Such apparatus is to be distinguished from continuous apparatus for making shaved ice or the like, which operates on somewhat different principles and produces soft ice.

U.S. Pat. No. 3,984,996 discloses an icemaker which freezes a vertical tube of ice of square cross section, and employs a central rotating shaft to drive the frozen tube upward. The apparatus is designed for continuous operation in a compartment of a home freezer, and has a pair of synchronized blade-type cutters at the top to fracture the slowly upwardly moving tube of ice into cube-like sections. U.S. Pat. Nos. 2,595,588 and 3,287,927 also disclose ice making machines which intermittently freeze a vertical column of ice and then eject the frozen column slowly upward to a breaking mechanism for fracturing the emerging column into pieces at an upper location. None of these designs has proven to be entirely satisfactory.

According to U.S. Pat. No. 4,429,543 to Fischer, assigned to the assignee of the present invention, a helix of ice is formed by circulating a refrigerant through the interior of a helical evaporator tubing section, while water is supplied to the exterior of the evaporator, preferably by immersion. Upon achievement of a desired thickness of ice, the supply of regfrigerant is discontinued and the evaporator is heated to break the ice bond. A driver is then actuated to rotate the ice helix slidably upon and along the helical evaporator, and to cause the leading edge of the ice helix to fracture upon reaching a length of tubing disposed at an angle from the regular curvature of the evaporator. The icemaker is very efficient in that, for a given size, it is capable of manufacturing relatively large quantities of ice within relatively short periods of time. However, efforts continue to be made to maximize the quantities of ice that may be produced by an icemaker of given size.

OBJECT OF THE INVENTION

An object of the present invention is to provide an improved icemaker which, for a given size, manufactures relatively large quantities of ice within relatively short periods of time.

SUMMARY OF THE INVENTION

In accordance with the present invention, a plurality of tubes of ice are formed by circulating a refrigerant through the interiors of a plurality of vertically oriented evaporator tubes arranged in parallel and in a circle within the interior of an ice making section, while water is supplied to the exterior surfaces of the evaporator tubes, preferably by immersion. Upon achievement of a desired thickness of the ice tubes, the supply of refrigerant is discontinued and the evaporator tubes are heated to break the ice bonds. A driver is then actuated to move the ice tubes along and slidably off of the evaporator tubes, and to cause the leading edges of the ice tubes to fracture upon leaving the evaporator tubes. The ice tubes are moved upwardly, so as to deliver the ice pieces into a chute at an upper location.

Other objects, advantages and features of the invention will become apparent upon a consideration of the following detailed description, when taken in conjunction with the accompanying drawings.

DETAILED DESCRIPTION

The icemakers of the invention are particularly adapted for use as parts of ice and beverage dispensing systems (not shown). Health departments throughout the United States have been advocating the ice dispenser concept, because ice can be dispensed mechanically, without contact with human hands, as opposed to the standard floor mounted, reach-in ice bins. Because carbonated beverage quality depends partly on the quality of the ice, which can provide up to one-third of a good drink's volume, there are substantial advantages in being able to provide ice pieces of the quality and clarity equal to that provided by the best ice cube making equipment now on the market, most of which equipment discharges cubes from a location below the region where freezing occurs. Accordingly, the icemakers of the invention are illustrated in their preferred orientation, wherein they are aligned about a vertical axis to discharge ice pieces from near their tops, so that the pieces can fall by gravity through a chute into an adjacent ice dispensing hopper (not shown). However, it should be recognized that the icemakers are capable of operating in other than vertical orientations, and are also capable of discharging ice pieces from their lower ends should that be desired for some particular purpose.

Figure 1:
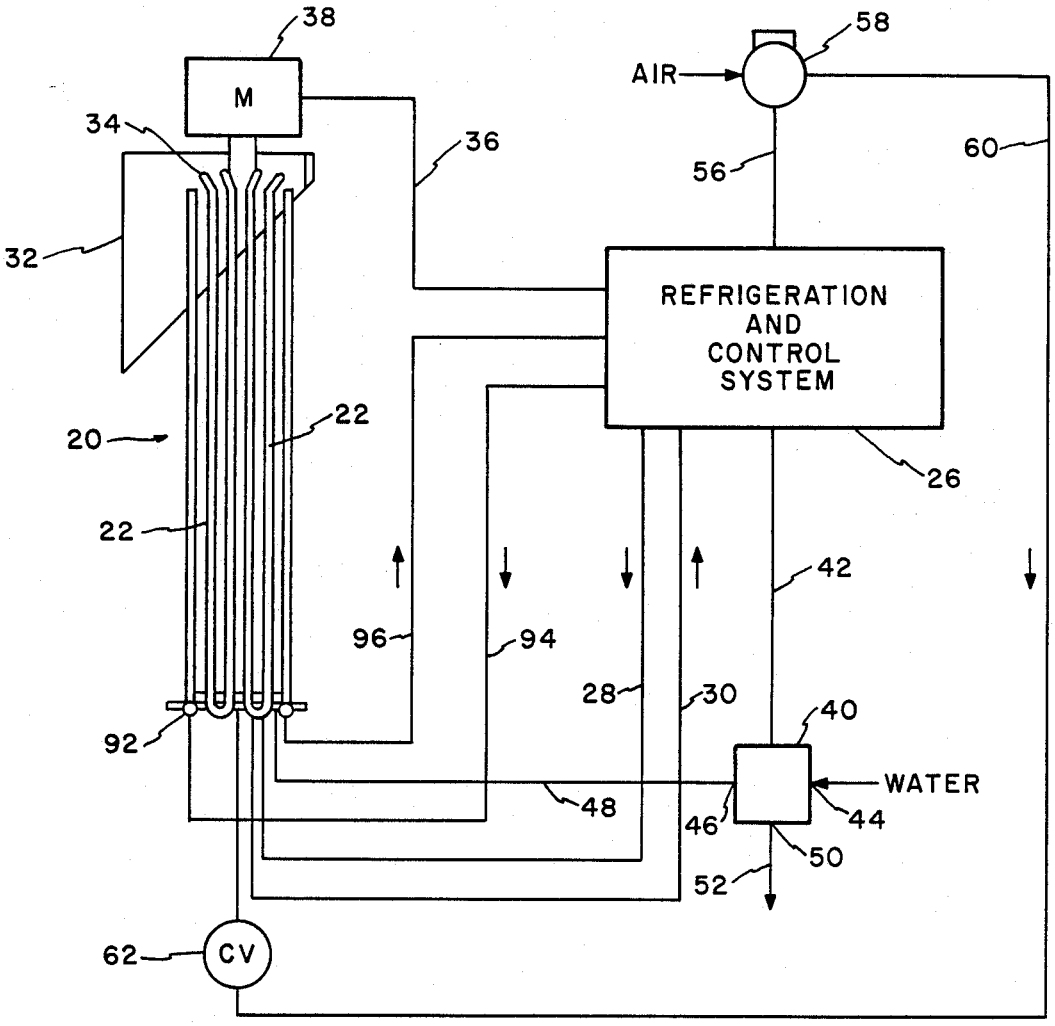
FIG. 1 is a side elevation view, partly in cross section and partly schematic, illustrating an ice making system in accordance with the teachings of the present invention.
Figure 2:
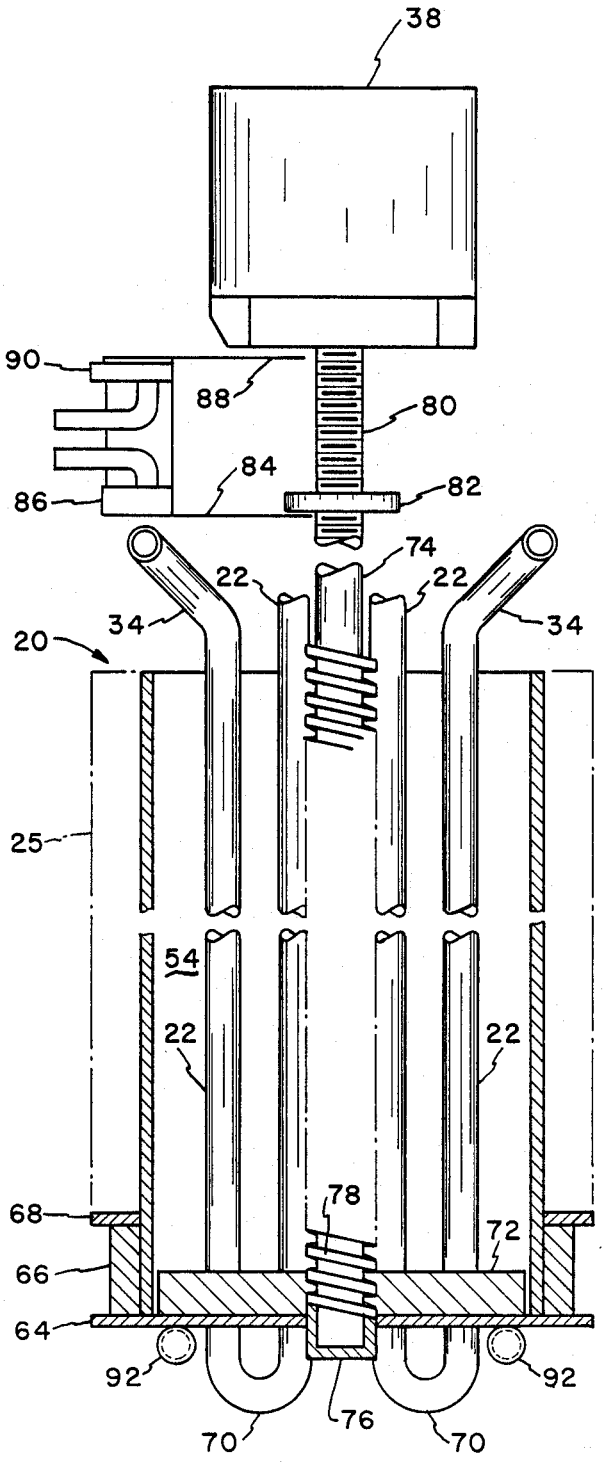
FIG. 2 is a cross sectional side elevation view of an icemaker structured in accordance with one embodiment of the invention.

In accordance with one embodiment of the invention, and as seen in FIGS. 1 and 2, an icemaker 20 has a plurality of vertically oriented, parallel tubes 22 that serve as evaporators, with water being supplied to the outer surfaces thereof. The tubes are disposed in a circle in a surrounding well 24 of circular cross section, which advantageously is surrounded by a thermally insulating jacket 25 and may be filled with water to a desired depth to immerse substantially the entirety of the tubes. A low-boiling point liquid refrigerant, such as Freon-22, is supplied by a refrigeration and control system 26 through a line 28 and an expansion valve (not shown) to a lower inlet to the tubes. The evaporating refrigerant takes up heat from the surrounding water, causing tubes of ice 29 (FIG. 3) to form on the exterior surfaces of the evaporator tubes, and is then returned from a lower outlet from the tubes to the refrigeration system through a line 30.

When the ice tubes reach a desired wall thickness, the supply of refrigerant is halted and the evaporator tubes 22 are heated to break the thermal bond between the interior surfaces of the ice tubes and the exterior surfaces of the evaporator tubes. A driver is then actuated to harvest the ice, causing the tubes of ice to travel upward along and in sliding contact with the evaporator tubes. The leading edges of the ice tubes are fractured into ice pieces within a discharge spout 32, and although any suitable fracturing device can be used, preferably each evaporator tube 22 continues as a short length 34 that extends out of the vertical axes of the tubes in a direction toward the exterior of the well 24, thereby to cause the rigid ice tubes to fracture as their leading ends are forced to try to follow a different path.

The refrigeration and control system 26 advantageously includes the components of the refrigeration system disclosd by said U.S. Pat. No. 4,429,543, assigned to the assignee of the present invention, and the teachings of which are specifically incorporated herein by reference. In addition, it includes controls (not shown) of a conventional type for applying the power through a conductor 36 to a motor 38 coupled with a driver for moving the ice tubes off of the evaporator tubes 22 during an ice harvest cycle, and for operating a water valve 40 via a control line 42. An inlet 44 to the valve connects with a supply of water, a combination inlet/outlet 46 of the valve connects through a line 48 with a water inlet/outlet in a lower end of the well 24, and an outlet 50 from the valve is coupled to a drain through a line 52. The valve is operable to selectively establish a path between the inlet 44 and inlet/outlet 46, to establish a path between the inlet/outlet 46 and outlet 50, or to interrupt all paths through the valve. At the beginning of an ice harvest cycle, a path is established between the inlet/outlet 46 and outlet 50 to drain remaining unfrozen water from the well through the drain line 52. After the water is drained, the tubes of ice frozen on the evaporator tubes are harvested and, prior to the end of the harvest cycle, the valve is operated to establish a path between the inlet 44 and inlet/outlet 46, so that fresh water is introduced into the well to substantially immerse the evaporator tubes in preparation for the next ice freezing cycle. Draining unfrozen water from the well at the beginning of each ice harvest cycle ensures that only fresh water is used for making ice, and prevents a buildup of minerals in the well and excess minerals in the ice.

If water within an ice evaporator water space 54 in the well 24 of the icemaker 20 were allowed to remain in a quiescent state during freezing, the resulting ice tubes formed on the evaporator tubes 22 would be cloudy. Although cloudy ice is suitable from a sanitary standpoint, it is not desirable for service to customers, since it does not have an aesthetically "clean" appearance. Therefore, in order that the icemaker will produce clear ice, it is contemplated that the water in the well be agitated during freezing, and this is accomplished by pumping air into the bottom of the icemaker for percolation upwardly through the water to agitate the water during the freezing cycle. To this end, the refrigeration and control system 26 also applies power through a conductor 56 to a motor driven air pump 58 during ice freezing cycles of the icemaker, an outlet from which pump connects to the lower end of the well through a line 60 and a check valve 62.

Figure 4:
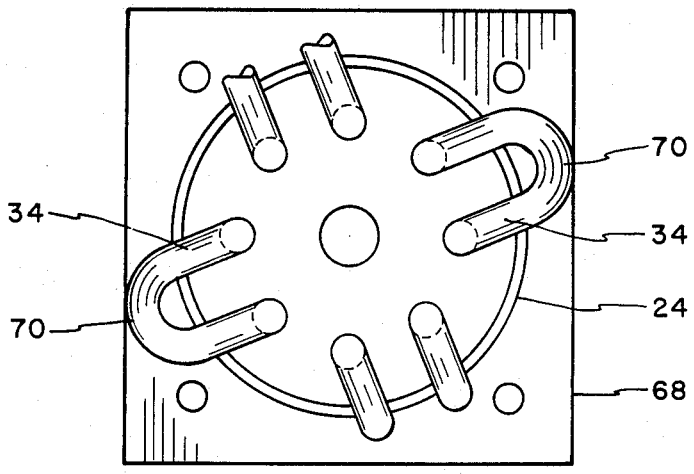
FIG. 4 is a top plan view of the icemakers of FIGS. 2 and 3.

With particular reference to FIGS. 2 and 4, the well 24 comprises a generally cylindrical tube, which may be of PVC plastic, clamped at its lower end to a base plate 64 of a thermally conductive material, such as stainless steel. To clamp the well to the base, a cylindrical collar 66, which may also be of PVC plastic, is adhered to and around the lower end of the well, and a plurality of fasteners (not shown) are extended between the base and a plate 68, positioned around the well above the collar, to draw the base and lower end of the well into fluid sealed relationship.

The base 64 is apertured for liquid sealed passage of the evaporator tubes 22, which extend through the well 24 parallel to each other and to the axis of the well, to and slightly beyond an open upper end of the well. An even number of evaporator tubes are arranged in a circle within the well, such that about a $\frac{3}{8}''$ to $\frac{1}{2}''$ thickness of ice can build up on the surface of each tube without touching ice on an adjacent tube or the inner surface of the well. The evaporator tubes are connected in series by means of tubular bends 70, with an inlet to an outlet from the series connected tubes being beneath the base 64 for connection with respective refrigeration and control system lines 28 and 30. The tubular bends at the top of the icemaker 20 connect with the extensions 34 of the evaporator tubes, which may be angled at about 45° with respect to the vertically oriented evaporator tubes, so that during a harvest cycle the ice tubes, upon encountering the extensions, will break off in good-sized pieces and fall into the chute 32 for collection.

Within and movable along the axis of the well 24 is a plate or piston 72 that has a diameter slightly less than the inside diameter of the well. The piston is of a thermally conductive material, such as stainless steel, and to accommodate its insertion into the well, it is provided with U-shaped slots (not shown) which relatively closely receive individual ones of the evaporator tubes 22.

A lead screw 74 extends coaxially through the well 24 between an output from the motor 38 and a bearing housing 76 carried by the base 64. A portion 78 of the lead screw within the well has threads of a first pitch engaged with threads in a center passage through the piston 72, so that upon rotation of the lead screw in one direction, the piston is moved upwardly through the well, and upon rotation in the opposite direction, the piston is moved downwardly. An upper portion 80 of the lead screw has threads of a second and smaller pitch engaged with threads in a center passage through a nonrotating yoke 82. The yoke moves upwardly and downwardly along with the piston, but because of the smaller pitch of the threaded portion 80, the distance traveled by the yoke is less than that of the piston. Movement of the yoke along the portion 80 during an ice harvest cycle controls operation of the motor 38, such that when the piston is at its lowermost position on and against the base 64, the yoke also is at its lowermost position in engagement with a control arm 84 of a stop switch 86, and so that when the piston is in its uppermost position, the yoke also is in its uppermost position in engagement with a control arm 88 of a reversing switch 90.

The icemaker 20 operates on a cyclic basis, such that freezing of ice tubes on the evaporator tubes 22 first occurs, followed by heating of the evaporator tubes to break the bond between the ice tubes and evaporators, followed by moving the ice tubes off of the evaporator tubes and fracturing the leading ends of the ice tubes into pieces, with the cycle being repeated so long as there is a demand for ice pieces. As a first step in the cycle, the refrigeration and control system 26 operates the water valve 40 for a time sufficient to fill the well 24 with water to substantially immerse the evaporator tubes. After the well is full, the refrigeration system introduces high pressure refrigerant through the line 28 and the expansion valve into the inlet to the series connected evaporator tubes, which lowers the temperature of the evaporator tubes below the freezing point of water to begin a buildup of ice tubes on the exterior surfaces of the evaporator tubes, with the refrigerant exiting from the evaporator tubes and returning to the refrigeration system through the line 30.

The piston 72 is in its lowermost position during the ice making cycle, and to prevent it from being frozen in place, a circular heating tube 92 is soldered to the bottom of the base 64. The heating tube is connected in series between a receiver and an accumulator (neither shown) of the refrigeration system 26 by means of refrigerant lines 94 and 96, whereby relatively warm liquid refrigerant condensed and stored in the receiver flows through the tube 92 on its way to the accumulator. Heat from the refrigerant in the tube is transferred to the base to heat the base to a temperature above freezing during an ice making cycle, which lowers the effort required to break loose and initiate movement of the piston during an ice harvest cycle.

When the ice tubes on the evaporators 22 have built up to a desired thickness, a harvest cycle begins. The thickness of the ice tubes can be determined using any of several different techniques well known in the art, for example by using a sensor 98 (FIG. 3) that generates a signal when one of the ice tubes grows to sufficient thickness to contact it or, in the alternative, a timed operation may be used, whereby freezing is carried out for a predetermined period of time. In any event, upon initiation of a harvest cycle, the refrigeration and control system 26 operates the water valve 40 to drain the well 24 of unfrozen water, and shunts hot refrigerant at an outlet from a compressor (not shown) directly to the inlet to the series connected evaporator tubes to heat the tubes and break the thermal bonds between the exterior surfaces of the tubes and the ice tubes.

After hot refrigerant has been supplied to the evaporator tubes 22 for a time sufficient to break the thermal bonds between the ice tubes and the evaporator tubes, the refrigeration and control system 26 operates the motor 38 to rotate the lead screw 74 in the direction causing the piston 72 to move upwardly within the well 24, discontinues supply of hot refrigerant to the evaporator tubes, commences introduction of refrigerant through the expansion valve into the tubes, and operates the valve 40 to fill the well with water. As the piston is driven upwardly, it pushes the ice tubes slidably along and off of the evaporator tubes, causing leading ends of the ice tubes to engage the angled extensions 34 at the upper ends of the evaporator tubes and to break off into ice pieces as the ice tubes attempt to follow the different curvatures of the extensions.

As the piston 72 moves upwardly through the well 24, the nonrotating yoke 82 also moves upwardly along the lead screw portion 80. The arrangement is such that upon the piston reaching the upper end of the well, at which point the entirety of the ice tubes will have been harvested, the yoke engages the control arm 88 of the reversing switch 90, causing the motor 38 to reverse and move the piston downwardly through the well. The yoke then moves downwardly along with the piston, and contacts the control arm 84 of the stop switch 86 just as the piston is moved against the base 64, which deenergizes the motor 38. The next ice freezing cycle then takes place.

Figure 3:
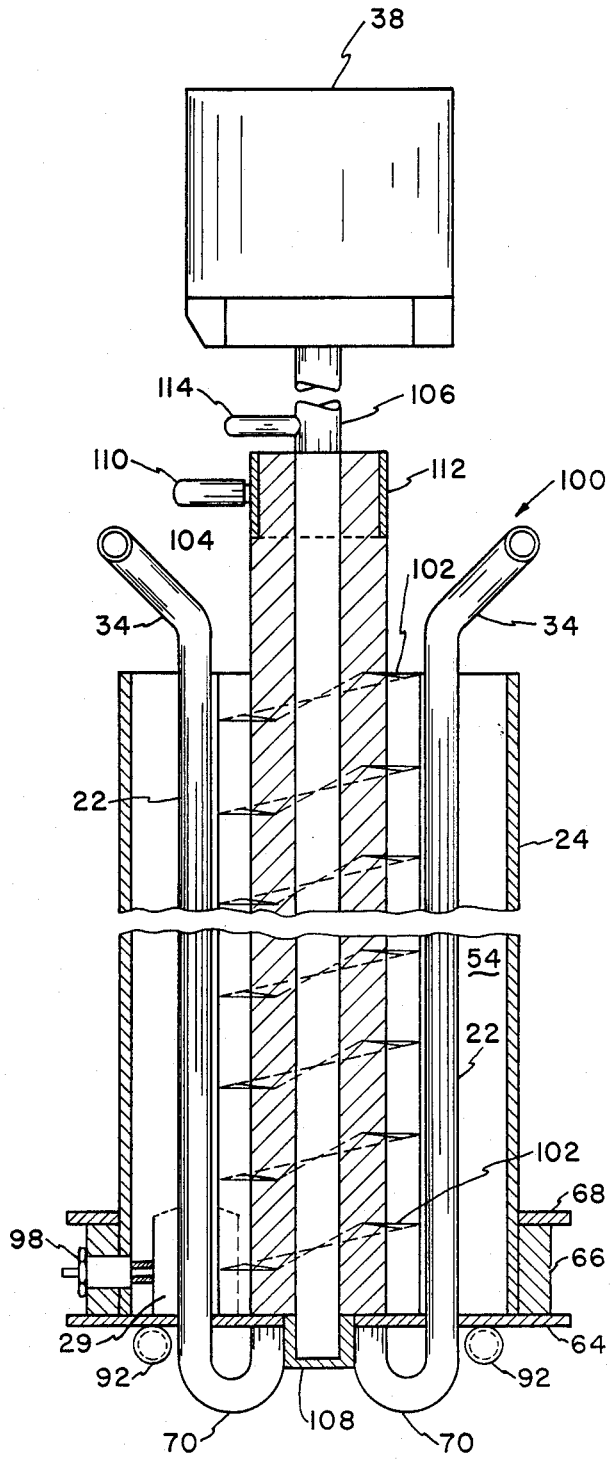
FIG. 3 is a cross sectional side elevation view of an icemaker structured in accordance with another embodiment of the invention.

FIG. 3 illustrates an alternate embodiment of icemaker 100, in which like reference numerals denote like components. The primary difference between the two embodiments resides in the drive means for harvesting ice tubes frozen onto the evaporator tubes 22, which in the embodiment of FIG. 2 comprises a piston and lead screw, and in the embodiment of FIG. 3 comprises a helical driver.

In particular, the helical driver may consist of an edge-wound stainless steel strip 102, wound into a plastic arbor 104 into which a high pitch groove of about 1 inch/turn has been cut. The arbor is carried by a shaft 106 pressed into and through a longitudinal passage through the arbor and extending between the output of the motor 38 and a bearing housing 108 carried by the icemaker base 64. The shaft and arbor extend coaxially with the well 24, and the strip 102 defines a helical ramp that extends toward but spaced from the evaportor tubes 22. During an ice making cycle, ice tubes frozen onto the evaporator tubes grow into the helical ramp.

When the ice tubes have grown to a sufficient thickness the harvest cycle is begun, at which point hot refrigerant is introduced into the evaporator tubes to break the thermal bonds between the ice tubes and evaporators, and unfrozen water is drained from the well 24. At this time also, the output from a low voltage, high current transformer (not shown) is applied across opposite ends of the stainless steel ramp 102 to heat the ramp and break the thermal bonds between it and the ice tubes. To this end, the output from the transformer is connected to a brush 110 that rides on a commutator 112 carried by and around the upper end of the arbor 104, which commutator is electrically connected to the upper end of the ramp, and to a brush 114 that rides on the upper end of the shaft 106, which is of an electrically conductive material and connected toward its lower end with the bottom of the ramp. After the ramp has been heated, the motor 38 is energized to rotate the arbor and ramp, so that the ramp moves the ice tubes upwardly along and off of the evaporator tubes 22, with the leading ends of the ice tubes being fractured into pieces of ice as they attempt to follow the extensions 34. Heating of the helical ramp is not required if the motor 38 has sufficient torque to break the ice bond between the ramp and ice tubes.

While embodiments of the invention have been described in detail, it is understood that various modifications and other embodiments thereof may be devised by one skilled in the art without departing from the spirit and scope of the invention, as defined in the appended claims.

What is claimed is:

1. An ice making apparatus, comprising a plurality of generally straight evaporator tubes; drive means located adjacent said evaporator tubes; means for supplying water to the exterior surfaces of said evaporator tubes; means for supplying refrigerant to the interiors of said evaporator tubes, so that evaporation takes place within said tubes to cause the freezing of tubes of ice on exterior surfaces of said evaporator tubes; means for heating said evaporator tubes above the freezing point of water to free the ice tubes from their bonds to said evaporator tubes following discontinuation of supply of refrigerant to and evaporation of refrigerant within said evaporator tubes; means for operating said drive means to move the ice tubes along and off of said evaporator tubes; and means for fracturing the leading ends of the ice tubes into smaller ice pieces as the ice tubes move off of said evaporator tubes.

2. Apparatus as in claim 1, wherein said evaporator tubes are in parallel relationship.

3. Apparatus as in claim 1, wherein said evaporator tubes are arranged in parallel on and around the circumference of a circle.

4. Apparatus as in claim 2, wherein said drive means includes a plate positionable toward one end of said evaporator tubes during freezing of ice onto said tubes, said evaporator tubes extending through said plate, and said operating means moving said plate toward an opposite end of said evaporator tubes to move the ice tubes along and off of said evaportor tubes.

5. Apparatus as in claim 4, wherein means are provided for warming said plate to obviate formation of a strong bond of ice to said plate.

6. Apparatus as in claim 2, wherein said evaporator tubes extend vertically, and including tubular enclosure means surrounding and having an axis generally parallel to said evaporator tubes, the ice tubes being moved off of said evaporator tubes toward upper ends thereof, whereby water can be supplied to said enclosure means at a lower location and ice pieces can be discharged at an elevated location.

7. Apparatus as in claim 6, wherein said water supply means fills said tubular enclosure with sufficient water to immerse substantial portions of said evaporator tubes.

8. Apparatus as in claim 7, wherein means is provided for supplying air to a lower location within said water filled enclosure during freezing of ice tubes, so as to agitate the water and promote the formation of tubes of clear ice.

9. Apparatus as in claim 2, wherein said evaporator tubes are connected in series and said series connected evaporator tubes have an inlet for receiving refrigerant from said refrigerant supplying means and an outlet through which refrigerant is returned to said refrigerant supplying means.

10. Apparatus as in claim 2, wherein said refrigerant supplying means includes a compressor for withdrawing evaporated refrigerant from said evaporator tubes and for increasing the pressure thereof, and wherein said means for heating said evaporator tubes comprises means for supplying the high pressure refrigerant directly thereto.

11. An ice making apparatus, comprising a plurality of generally straight evaporator tubes; drive means located adjacent said evaporator tubes; means for supplying water to the exterior surfaces of said evaporator tubes; means for supplying refrigerant to the interiors of said evaporator tubes, so that evaporation takes place within said tubes to cause the freezing of tubes of ice on exterior surfaces of said evaporator tubes; means for heating said evaporator tubes above the freezing point of water to free the ice tubes from their bonds to said evaporator tubes following discontinuation of supply of refrigerant to and evaporation of refrigerant within said evaporator tubes; means for operating said drive means to move the ice tubes along and off of said evporator tubes; and means for fracturing the leading ends of the ice tubes into smaller ice pieces as the ice tubes move off of said evaporator tubes, wherein said evaporator tubes are in parallel relationship and said means for fracturing the ice tubes includes extensions at one each of each of said evaporator tubes that extend out of parallel relationship with said evaporator tubes.

12. An ice making appartus, comprising a plurality of generally straight evaporator tubes; drive means located adjacent said evaporator tubes; means for supplying water to the exterior surfaces of said evaporator tubes; means for supplying refrigerant to the interiors of said evaporator tubes, so that evaporation takes place within said tubes to cause the freezing of tubes of ice on exterior surfaces of said evaporator tubes; means for heating said evaporator tubes above the freezing point of water to free the ice tubes from their bonds to said evaporator tubes following discontinuation of supply of refrigerant to and evaporation of refrigerant within said evaporator tubes; means for operating said drive means to move the ice tubes along and off of said evaporator tubes; and means for fracturing the leading ends of the ice tubes into smaller ice pieces as the ice tubes move off of said evaporator tubes, wherein said evaporator tubes are arranged in parallel on and around the circumference of a circle, and said drive means includes a rotatable shaft located coaxially with the circle and parallel to said evaporator tubes and a helical ramp extending around and along said shaft for engaging the interiors of the ice tubes, and said means for operating rotates said shaft and ramp to move the ice tubes along and off of said evaporator tubes.

13. Apparatus as in claim 12, including means for warming said ramp to obviate formation of strong bonds between said ramp and the ice tubes.

14. Apparatus as in claim 13, wherein said ramp is of electrically conductive material and said means for warming includes means for causing electrical current to flow through said ramp.

15. A method of making ice, comprising the steps of supplying refrigerant to the interiors of a plurality of generally straight evaporator tubes; supplying water to the exteriors of the evaporator tubes, the refrigerant being at a temperature such that the freezing of tubes of ice occurs on the exterior surfaces of the evaporator tubes; heating the evaporator tubes above the freezing point of water to free the ice tubes from their bonds to the evaporator tubes following discontinuation of supply of refrigerant thereto; moving the ice tubes along and off of the evaporator tubes; and fracturing the leading ends of the ice tubes into smaller ice pieces as the ice tubes move off of the evaporator tubes.

16. A method as in claim 15, wherein said evaporator tubes are in parallel relationship, and wherein said moving step comprises pushing against one end of the ice tubes to move the same along and off of the evaporator tubes.

17. A method as in claim 16, wherein a tubular enclosure surrounds and has an axis generally parallel to the evaporator tubes, said water supplying step comprises introducing water into a lower end of said enclosure, and said fracturing step comprises fracturing the ice tubes toward an upper end of the enclosure.

18. A method as in claim 17, wherein said step of supplying water introduces sufficient water into the enclosure to substantially immerse the evaporator tubes.

19. A method as in claim 18, including the step of supplying air to a lower location within said water filled enclosure during freezing of ice tubes to agitate the water and promote the formation of tubes of clear ice.

20. A method of making ice, comprising the steps of supplying refrigerant to the interiors of a plurality of generally straight evaporator tubes; supplying water to the exteriors of the evaporator tubes, the refrigerant being at a temperature such that the freezing of tubes of ice occurs on the exterior surfaces of the evaporator tubes; heating the evaporator tubes above the freezing point of water to free the ice tubes from their bonds to the evaporator tubes following discontinuation of supply of refrigerant thereto; moving the ice tubes along and off of the evaporator tubes; and fracturing the leading ends of the ice tubes into smaller ice pieces as the ice tubes move off of the evaporator tubes, wherein said evaporator tubes are in parallel relationship, and said moving step comprises pushing against one end of the ice tubes to move the same along and off of the evaporator tubes, and said fracturing step comprises forcing the leading ends of the ice tubes to try to follow paths that are out of parallelism with the evaporator tubes.

21. A method of making ice, comprising the steps of supplying refrigerant to the interiors of a plurality of generally straight evaporator tubes; supplying water to the exteriors of the evaporator tubes, the refrigerant being at a temperature such that the freezing of tubes of ice occurs on the exterior surfaces of the evaporator tubes; heating the evaporator tubes above the freezing point of water to free the ice tubes from their bonds to the evaporator tubes following discontinuation of supply of refrigerant thereto; moving the ice tubes along and off of the evaporator tubes; and fracturing the leading ends of the ice tubes into smaller ice pieces as the ice tubes move off of the evaporator tubes, wherein said evaporator tubes are arranged in parallel on and around the circumference of a circle, and said moving step comprises engaging the ice tubes with a helical ramp extending coaxial to the circle, and rotating the ramp about its axis to move the ice tubes along and off of the evaporator tubes.

22. A method as in claim 21, wherein said fracturing step comprises forcing the leading ends of the ice tubes to try to follow paths that are out of parallelism with the evaporator tubes.

23. A method as in claim 21, including the step of warming the helical ramp to obviate formation of a strong bond between the ramp and the ice tubes.

24. A method as in claim 23, wherein the helical ramp is of electrically conductive material, and said warming step comprises causing an electrical current to flow through the ramp.

* * * * *